US012584702B2

(12) United States Patent
Zusman

(10) Patent No.: US 12,584,702 B2
(45) Date of Patent: Mar. 24, 2026

(54) GRIP MODULE FOR HANDGUN

(71) Applicant: IMI Defense LTD, Ein Ayala (IL)

(72) Inventor: Nisim Zusman, Ein Ayala (IL)

(73) Assignee: IMI Defense LTD, Ein Ayala (IL)

( * ) Notice: Subject to any disclaimer, the term of this patent is extended or adjusted under 35 U.S.C. 154(b) by 0 days.

(21) Appl. No.: 18/807,583

(22) Filed: Aug. 16, 2024

(65) Prior Publication Data

US 2025/0060179 A1 Feb. 20, 2025

Related U.S. Application Data

(63) Continuation-in-part of application No. 29/904,424, filed on Oct. 6, 2023.

(60) Provisional application No. 63/532,952, filed on Aug. 16, 2023.

(51) Int. Cl.

| | |
|---|---|
| ***F41A 3/66*** | (2006.01) |
| ***F41C 23/02*** | (2006.01) |
| ***F41C 23/14*** | (2006.01) |
| ***F41G 11/00*** | (2006.01) |

(52) U.S. Cl.

CPC ..... *F41A 3/66* (2013.01); *F41C 23/02* (2013.01); *F41C 23/14* (2013.01); *F41G 11/003* (2013.01)

(58) Field of Classification Search

CPC .... F41A 3/66; F41A 3/72; F41A 35/06; F41C 23/02; F41C 23/14; F41C 23/04; F41C 23/12; F41C 33/0263; F41C 23/10; F41C 33/0227; F41C 23/00; F41C 33/04; F41G 11/003

USPC ..... 124/56, 72, 73; 42/71.02

See application file for complete search history.

(56) References Cited

U.S. PATENT DOCUMENTS

| | | | | |
|---|---|---|---|---|
| 5,349,938 | A * | 9/1994 | Farrell | F41B 11/723 124/72 |
| 5,503,137 | A | 4/1996 | Fusco | |
| 6,371,341 | B1 | 4/2002 | Clifton, Jr. | |
| 7,694,860 | B2 | 4/2010 | Clifton, Jr. | |
| 7,762,018 | B1 * | 7/2010 | Fitzpatrick | F41C 23/22 42/73 |
| 8,448,366 | B2 | 5/2013 | Faifer | |
| 9,459,073 | B1 * | 10/2016 | Kloeppel | F41C 23/20 |
| 9,658,017 | B2 * | 5/2017 | Alicea | F41A 19/59 |
| 9,677,846 | B1 | 6/2017 | Vankeuren, III | |
| 9,791,238 | B2 * | 10/2017 | Bowen | F41C 23/14 |
| D846,057 | S | 4/2019 | Cheng et al. | |
| 10,502,523 | B1 | 12/2019 | Chester | |
| D882,704 | S | 4/2020 | Iwasawa | |

(Continued)

OTHER PUBLICATIONS

"AK47/AK74 Polymer Pistol grip"; IMIDefense.com; retrieved May 13, 2024; date unkown, prior to the filing date of the present Application; URL: <https://imidefense.com/product/ak47-ak74-eg-polymer-pistol-grip/>.

(Continued)

*Primary Examiner* — Michael D David

(74) *Attorney, Agent, or Firm* — Banner & Witcoff, Ltd.

(57) ABSTRACT

A grip module system for a handgun or other firearm may include a lower receiver, a pistol grip affixed to the lower receiver, a buffer tube attachment point affixed to a rear portion of the lower receiver, and an accessory rail removably attached to a top of the buffer tube attachment point. The grip module system may be configured to accept and engage the firing components of various semi-automatic and automatic pistols or rifles.

20 Claims, 7 Drawing Sheets

(56) References Cited

U.S. PATENT DOCUMENTS

| | | | | |
|---|---|---|---|---|
| 10,619,974 | B2 | 4/2020 | Smith et al. | |
| 10,731,934 | B2 * | 8/2020 | Song | F41A 3/66 |
| 10,731,938 | B2 | 8/2020 | Alicea, Jr. | |
| D897,477 | S | 9/2020 | Jonsson | |
| 10,866,052 | B2 * | 12/2020 | Berean | F41A 9/55 |
| 10,890,391 | B1 * | 1/2021 | Geissele | F41A 3/66 |
| 10,996,024 | B2 | 5/2021 | Smith et al. | |
| 11,187,492 | B2 | 11/2021 | Mumford | |
| 11,193,724 | B1 | 12/2021 | McCarthy | |
| 11,199,370 | B1 * | 12/2021 | Sugg | F41A 5/26 |
| 11,262,158 | B2 | 3/2022 | Cahill et al. | |
| 11,365,952 | B2 * | 6/2022 | Hopkins | F41C 23/14 |
| 11,512,913 | B1 | 11/2022 | Christensen | |
| 11,592,262 | B2 | 2/2023 | Porat | |
| 11,644,260 | B1 * | 5/2023 | Douvier | F41A 11/02 42/75.01 |
| 11,740,041 | B2 * | 8/2023 | Vanek | F41C 23/20 89/199 |
| 11,898,814 | B2 * | 2/2024 | Alicea, Jr. | F41A 17/56 |
| D1,020,930 | S | 4/2024 | Lin | |
| 12,066,267 | B1 * | 8/2024 | Williams | F41A 3/66 |
| D1,052,034 | S | 11/2024 | Weiss | |
| 2002/0078616 | A1 | 6/2002 | Perry et al. | |
| 2007/0175935 | A1 | 8/2007 | Clifton | |
| 2009/0282718 | A1 * | 11/2009 | Bartley | F41C 23/12 42/75.03 |
| 2011/0088305 | A1 | 4/2011 | Oz | |
| 2013/0081314 | A1 | 4/2013 | Hatfield | |
| 2015/0000171 | A1 * | 1/2015 | Roberts | F41A 3/66 264/261 |
| 2015/0247698 | A1 * | 9/2015 | Bosco | F41C 33/001 42/72 |
| 2015/0345895 | A1 * | 12/2015 | Young | F41A 11/04 42/71.01 |
| 2016/0054094 | A1 * | 2/2016 | Colt | F41C 23/14 42/75.03 |
| 2016/0084599 | A1 * | 3/2016 | Alicea, Jr. | F41A 17/46 42/70.06 |
| 2016/0084601 | A1 * | 3/2016 | Alicea, Jr. | F41A 19/10 42/6 |
| 2016/0187099 | A1 * | 6/2016 | Cottle | F41C 23/14 42/73 |
| 2017/0131051 | A1 | 5/2017 | Albury | |
| 2019/0107366 | A1 * | 4/2019 | Reavis, III | F41C 23/12 |
| 2019/0226798 | A1 | 7/2019 | Faifer | |
| 2019/0257613 | A1 * | 8/2019 | Burkhart, III | F41C 23/12 |
| 2020/0191508 | A1 | 6/2020 | Satzinger et al. | |
| 2020/0191520 | A1 | 6/2020 | Kielsmeier et al. | |
| 2020/0200505 | A1 * | 6/2020 | Brown, Jr. | F41C 27/00 |
| 2020/0232731 | A1 | 7/2020 | Sharkov et al. | |
| 2020/0400403 | A1 * | 12/2020 | Vanek | F41C 23/14 |
| 2021/0063103 | A1 * | 3/2021 | Becklin | F41A 5/26 |
| 2021/0239423 | A1 * | 8/2021 | Liptak | F41C 23/14 |
| 2021/0372725 | A1 * | 12/2021 | Gibbens | F41A 17/36 |
| 2022/0381534 | A1 | 12/2022 | Vold et al. | |
| 2022/0397356 | A1 * | 12/2022 | Newman | F41A 17/38 |
| 2024/0068758 | A1 | 2/2024 | Saunders, Jr. et al. | |
| 2025/0060179 | A1 * | 2/2025 | Zusman | F41A 3/66 |

OTHER PUBLICATIONS

Strike, posted Dec. 3, 2022 [online], [retrieved Nov. 21, 2024]. Retrieved from internet, https://www.youtube.com/watch?v=XVIpTU5qJmc (Date:2024) (Year: 2022).

Mechtech, posted Feb. 8, 2023 [online], [retrieved Nov. 21, 2024]. Retrieved from internet, https://wwwv.firearmsnews.com/editorial/mechtech-10mm-conversion/469086 (Date:2024) (Year: 2023).

Bravo, posted May 9, 2024 [online], [retrieved Nov. 21, 2024]. Retrieved from internet, https://www.youtube.com/watch?v=XVIpTU5qJmc (Date:2024) (Year: 2024).

Carbine, posted Dec. 3, 2022 [online], [retrieved Nov. 21, 2024]. Retrieved from internet, https://www.mdshooters.com/threads/pistol-carbine-conversion-kits.171417/ (Date:2024) (Year: 2022).

Jan. 8, 2025—(WO) ISR and WO—App PCT/IB2024/057979.

Israel Defense Store I Tactical Gear. IMI Defense Kidon Modular Pistol Conversion Kit System. YouTube. Aug. 7, 2023. [Retrieved on Dec. 29, 2024]. Retrieved from internet: <URL: https://www.youtube.com/watch?v=vDtxOKDhXxQ>. entire video.

"Holster Product Search"; IMIDefense.com; retrieved May 13, 2024; date unkown, prior to the filing date of the present Application; URL: <https://imidefense.com/?s=holster&post_type=product&dgwt_wcas=1>.

* cited by examiner

GRIP MODULE FOR HANDGUN

RELATED APPLICATION DATA

This application claims priority to U.S. Provisional Patent Application No. 63/532,952, filed on Aug. 16, 2023, and U.S. Nonprovisional application Ser. No. 29/904,424, filed on Oct. 6, 2023, which are hereby incorporated by reference in their entireties.

TECHNICAL FIELD

This disclosure relates to the field of handguns and, more specifically, modular handgun accessories.

BACKGROUND

Modem firearms, and in particular, handguns or pistols, have developed into modular weapons that may be accessorized with various tactical devices such as accessory rails, optics, flashlights, etc. Accordingly, there is a need for a grip module system compatible with existing handguns and handgun components and for the attachment of accessories such as fixed and foldable or collapsible stocks.

SUMMARY

This Summary introduces a selection of concepts relating to this technology in a simplified form as a prelude to the Detailed Description that follows. This Summary is not intended to identify key or essential features.

In some aspects, a grip module system for a handgun is disclosed that may include a lower receiver, a pistol grip affixed to the lower receiver, a buffer tube attachment point affixed to a rear portion of the lower receiver, and an accessory rail removably attached to a top of the buffer tube attachment point. In some examples, the lower receiver may be configured to engage firing components of a handgun. In one example, the handgun is a Sig Sauer P320®. In another example, the handgun is a Springfield Echelon™. In still other examples, the handgun may be any modular/similar type of compatible handgun. In yet another example, the lower receiver, the pistol grip, and the buffer tube attachment point may comprise a carbon fiber, a polymer, an alloy, a metal, or combinations thereof. In some examples, the accessory rail may be a 1913 picatinny rail. In certain examples, the buffer tube attachment point may further comprise a quick-disconnect sling attachment point.

In another example, the rifle buffer tube is an AR-15 type buffer tube. In some examples, the rifle buffer tube is configured to engage a rifle stock. In yet other examples, the rifle stock is collapsible or foldable. In still other examples, the firing components of a handgun may include a barrel, a slide, a trigger, and a firing mechanism. In other examples, the grip module system may include a lower accessory rail configured to engage an illumination device. In still other examples, the accessory rail may be configured to engage an optic. In one example, the accessory rail may be configured to engage a laser or IR pointer.

In other aspects, a method of forming a grip module is disclosed that may include the steps of forming a lower receiver that may be configured to engage firing components of a handgun, forming a pistol grip affixed to the lower receiver, forming a buffer tube attachment point affixed to a rear portion of the lower receiver in which the buffer tube attachment point is configured to engage a rifle buffer tube, and forming an accessory rail removably attached to a top of the buffer tube attachment point. In another example, the lower receiver may be universally compatible with multiple handgun firing components. In other examples, the lower receiver, the pistol grip, and the buffer tube attachment point may be formed of a carbon fiber, a polymer, an alloy, a metal, or combinations thereof. In yet another example, the method may further include the step of forming a quick-disconnect sling attachment point affixed to the buffer tube attachment point. In still other examples, the rifle buffer tube may be configured to engage a rifle stock. In other examples, the rifle stock is collapsible or foldable.

In another aspect, a firearm is disclosed that may include a grip module, a slide configured to engage the grip module, a barrel configured to engage the slide and the grip module, a trigger the grip module, a firing mechanism configured to engage the trigger and the grip module. In some examples, the grip module may include a lower receiver configured to engage the slide, the barrel, the trigger, and the firing mechanism. In another example, a pistol grip may be affixed to the lower receiver, a buffer tube attachment point may be affixed to a rear portion of the lower receiver, and the buffer tube attachment point may be configured to engage a rifle buffer tube. In other examples, an accessory rail may be removably attached to a top of the buffer tube attachment point, and a rifle stock may be removably attached to the rifle buffer tube.

These and other features, advantages, and objects of the present disclosure will be further understood and appreciated by those skilled in the art by reference to the following specification, claims, and appended drawings, where various embodiments of the design illustrate how concepts of this disclosure may be used.

BRIEF DESCRIPTION OF THE DRAWINGS

A more complete understanding of features described herein and advantages thereof may be acquired by referring to the following description in consideration of the accompanying drawings, in which like reference numbers indicate like features.

DESCRIPTION OF THE EMBODIMENTS

In the following description of the various embodiments, reference is made to the accompanying drawings identified above and which form a part hereof, and in which is shown by way of illustration various embodiments in which features described herein may be practiced. It is to be understood that other embodiments may be utilized and structural and functional modifications may be made without departing from the scope described herein. Various features are capable of other embodiments and of being practiced or being carried out in various different ways.

As discussed above, a grip module for a handgun as disclosed herein may be manufactured with materials such as a polymer, a fiber reinforced polymer, plastics, composites, metals, alloys, or combinations thereof. The grip module may include a lower receiver, a pistol grip affixed to the lower receiver, a buffer tube attachment point affixed to a rear portion of the lower receiver, and an accessory rail removably or permanently attached to a top of the buffer tube attachment point. The accessory rail may be a 1913 picatinny rail for the attachment of optics, illumination devices, or other accessories. The buffer tube attachment point may be threaded for the attachment of accessories such as collapsible or foldable stocks. In other examples, a grip module for a handgun as disclosed herein may be configured to accept a handgun slide as well as the firing mechanism such as a barrel and the trigger housing group. The grip module may be compatible with existing handguns providing a lower platform that allows for the attachment of an increased number of accessories and a wider variety of different types of accessories. In some examples, the grip module may be configured to accept and engage a firing mechanism requiring a buffer tube and related components need for cycling the firearm. The grip module allows a semi-automatic or automatic pistol to be converted to a more tactical platform providing law enforcement, military, and civilians a modular platform that increases the performance, range, and accuracy of modem handguns while keeping the entire system in a smaller, more tactical package. The grip module disclosed herein converts a standard semi-automatic pistol to a personal defense weapon having a greater capability when a full-sized rifle is not practical to carry and offers greater accuracy and ability to control the firearm.

Figure 1A:
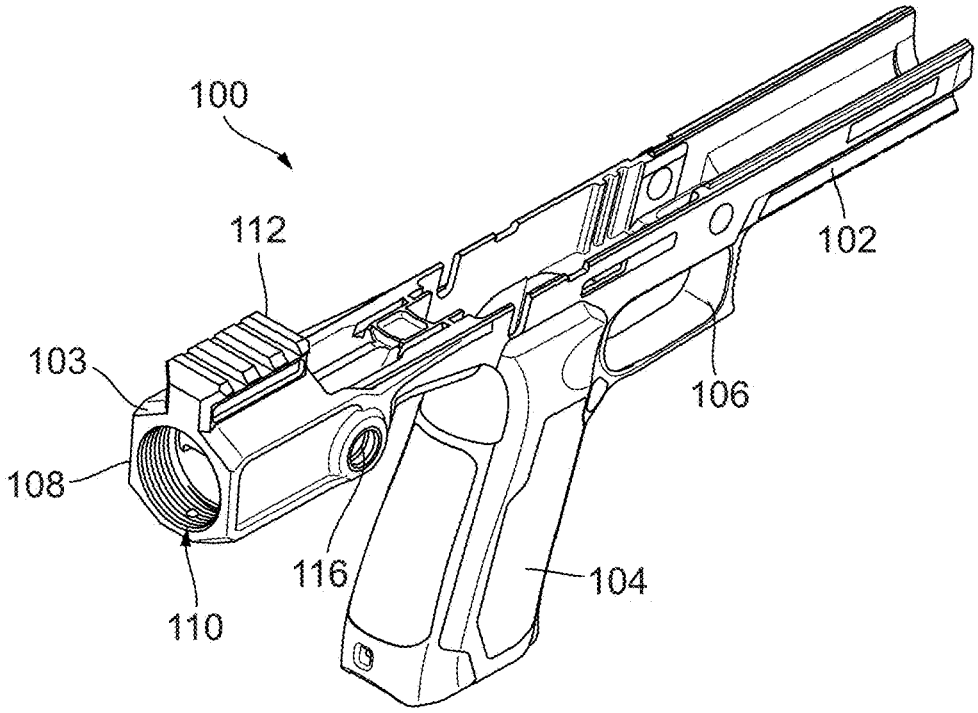
FIGS. 1A-1B are rear-right and rear-left side perspective views of a grip module for a handgun as disclosed herein.
Figure 1B:
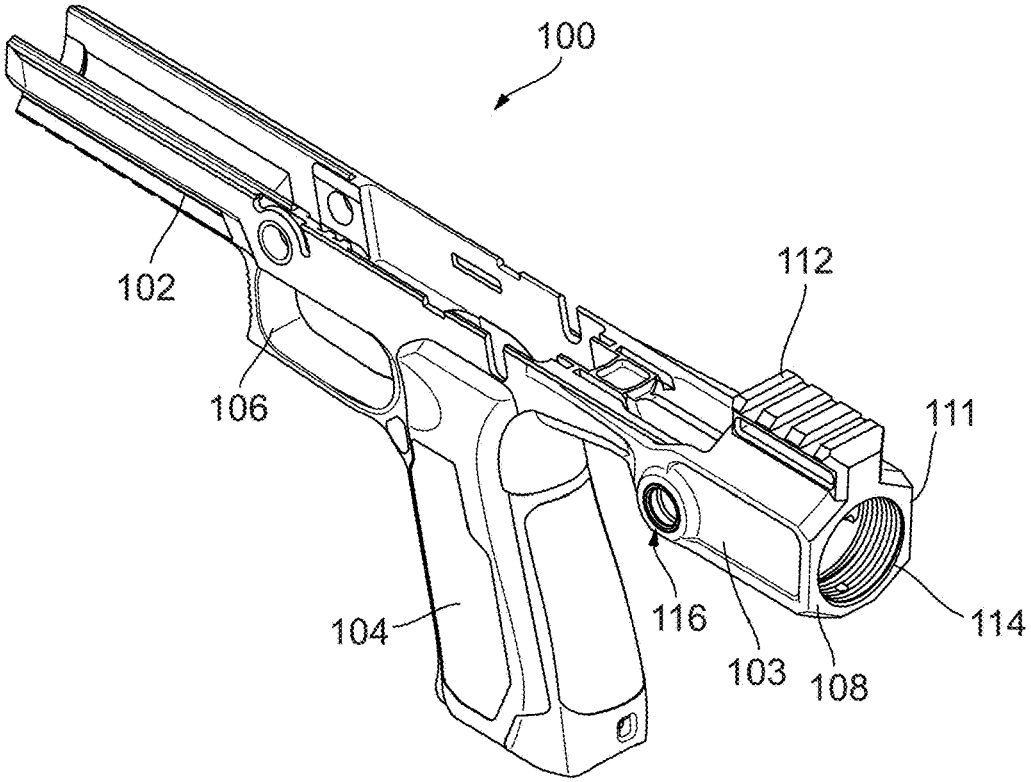

As shown in FIGS. 1A and 1B, grip module 100 may include lower receiver 102. Lower receiver 102 may be configured to accept and engage the internal components of a semi-automatic handgun such as a trigger mechanism, a barrel, a slide, and/or a pistol magazine. In some examples, lower receiver 102 may be universally compatible with various semi-automatic pistols. In one particular example, lower receiver 102 may be configured to engage various components of a Sig Sauer P320® pistol. Grip module 100 may also include pistol grip 104 affixed to lower receiver 102. In some examples, pistol grip 104 may be formed of materials such as a polymer, an elastomeric polymer (e.g., rubber), a carbon fiber reinforced polymer, plastics, composites, metals, alloys, or combinations thereof. In another example, pistol grip 104 may be removably attached to lower receiver 102 via a mechanical fastener such as a screw or bolt. In another example, pistol grip 104 may be integrally formed with lower receiver 102. In other examples, pistol grip 104 may include a safety device configured to engage a trigger mechanism integrated with grip module 100. As also shown in FIGS. 1A and 1B, grip module 100 may include a trigger guard 106 integrally formed with lower receiver 102 and abutting pistol grip 104. In some examples, pistol grip 104 is integrally formed with trigger guard 106. Rear portion 103 of lower receiver 102 may include buffer tube attachment point or receiver extension 108. Buffer tube attachment point 108 may include threading 110 on an interior portion of buffer tube attachment point 108 and may be configured to removably engage an AR15-type buffer tube (see FIG. 5). A buffer tube may include a buffer and spring. The buffer and spring may absorb the force of an interior bolt or other firing mechanism thereby cycling a new round into the barrel chamber after a round is fired. Grip module 100 may be configured to incorporate a bolt carrier group (not shown) into lower receiver 102. The bolt carrier group may be engaged with the buffer tube (see FIG. 5). In other examples, buffer tube attachment point or receiver extension 108 may be configured for the attachment of various tactical components such as a stock or arm brace. As shown in FIG. 1B, buffer tube attachment point 108 may include an endcap 111 removably engaged with buffer tube threading 110. In another example, buffer tube endcap 111 may include an attachment point 114 configured to attach to a sling or lanyard. Attachment point 114 may also be shaped in such a manner to engage a wrench of other tool that may be used to attach or remove endcap 111 from buffer tube attachment point 108. Grip module 100 may also include accessory rail 112 positioned on a top of rear portion 103 of lower receiver 102.

Figure 2:
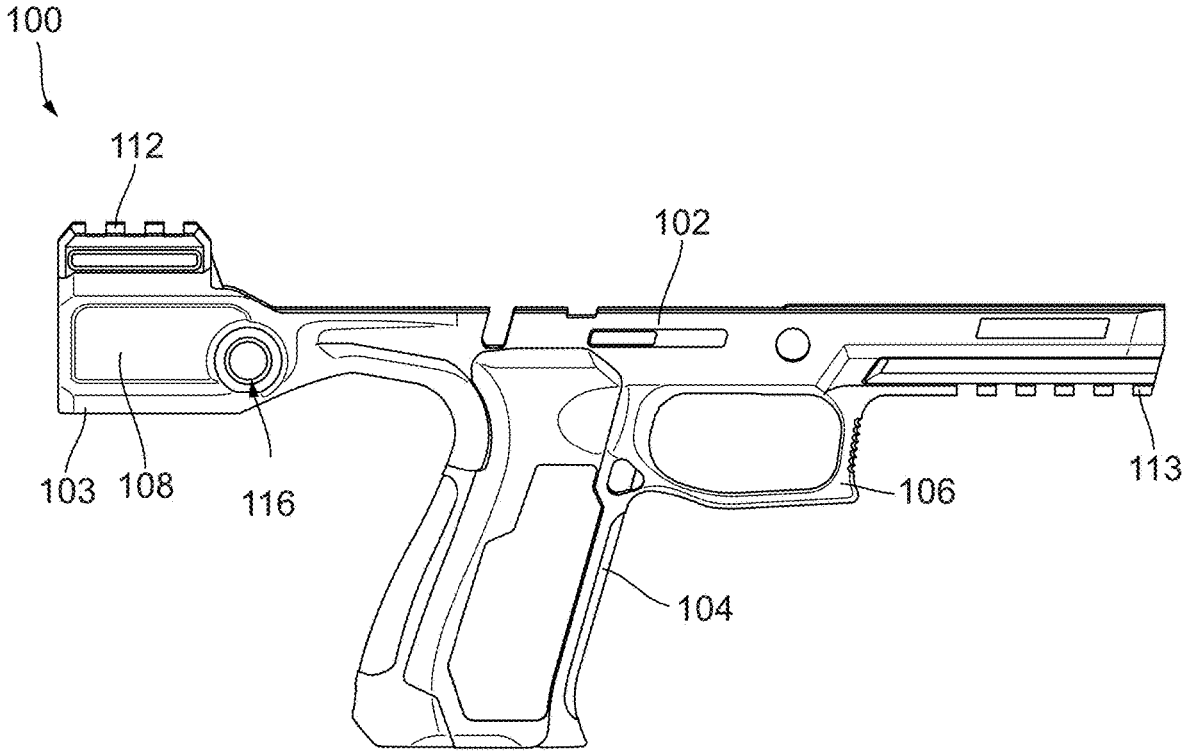
FIG. 2 is a side view of a grip module for a handgun as disclosed herein.

As shown in FIG. 2, the grip module 100 for a handgun as disclosed herein may include at least one quick-disconnect sling port 118 on an aft/rear portion 103 of lower receiver 102 or on the buffer tube attachment point 108. Quick-disconnect/detach sling port 118 may be configured to removably attach to sling swivels or other attachment points of one and two-point attachment slings. In another example, grip module 100 may include a first quick-disconnect/detach sling port 118 on an aft/rear portion 103 of lower receiver 102 or on the buffer tube attachment point 108, and a second quick-disconnect sling port 116 positioned opposite first quick-disconnect sling port 118 (see FIGS. 1A and 1B). First quick-disconnect/detach sling port 118 and second quick-disconnect sling port may be configured to attach to two-point attachment slings, or single-point attachment slings if a shooter prefers a single-point attachment sling on the left or right side of grip module 100. Grip module 100 may include an upper accessory rail 112 positioned near the aft portion of grip module 100. In another example, grip module 100 may include lower accessory rail 113 positioned on a lower forward portion of lower receiver 102. Accessory rails 112 and 113 may be configured as MIL-SPEC 1913 picatinny rails, KeyMod™ rails, and/or M-LOKT rails for the attachment of lights or other tactical accessories. Accessory rails 112 and 113 may be configured to removable engage tactical accessories such as optics, magnifiers, red dots, holographic sights, illumination devices, flashlights, IR pointers, IR designators, lasers, and combinations thereof. Grip module 100 pistol grip 104 may be configured to engage and accept short magazines or extended capacity magazines.

Figure 3A:
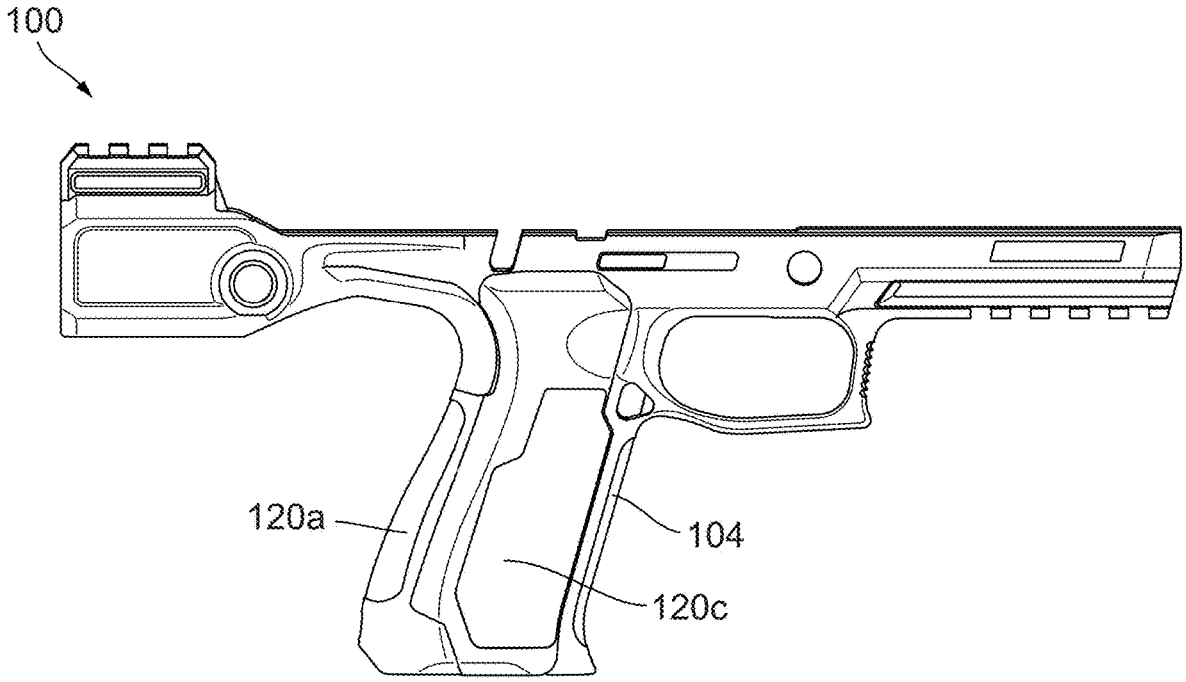
FIGS. 3A-3B are side views of a grip module for a handgun including interchangeable pistol or hand grip panels as disclosed herein.
Figure 3B:
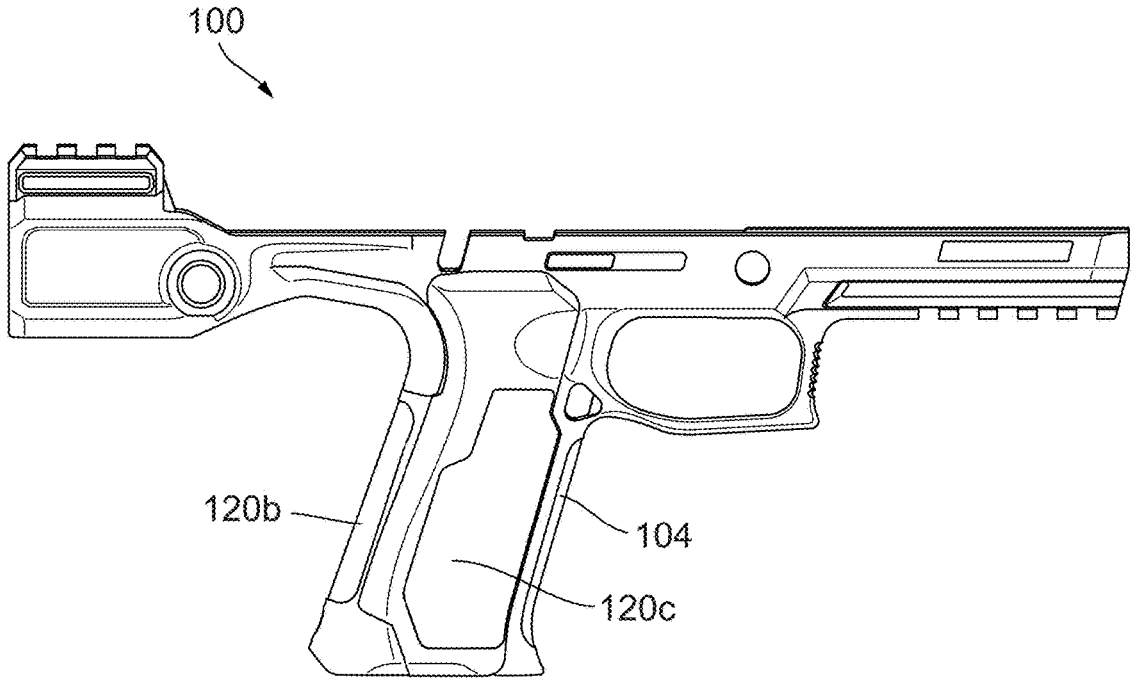

As shown in FIGS. 3A and 3B, grip module 100 may include interchangeable grip panels 120*a* and 120*b* that are configured to be removably attached to the backstrap of pistol grip 104. In some examples, grip panels 120*a* and 120*b* may be removably attached to pistol grip 104 via a mechanical fastener such as a screw or bolt. In other examples, grip panels 120*a* and 120*b* may be removably attached to pistol grip 104 via a friction fit, snap-on, or tongue and groove attachment device in which grip panels 120*a* and 120*b* may be attached or removed from pistol grip 104 without a mechanical fastener. An individual may configure pistol grip 104 with interchangeable panels grip panels 120*a* or 120*b* to a desired configuration based upon individual preference.

Figure 4:
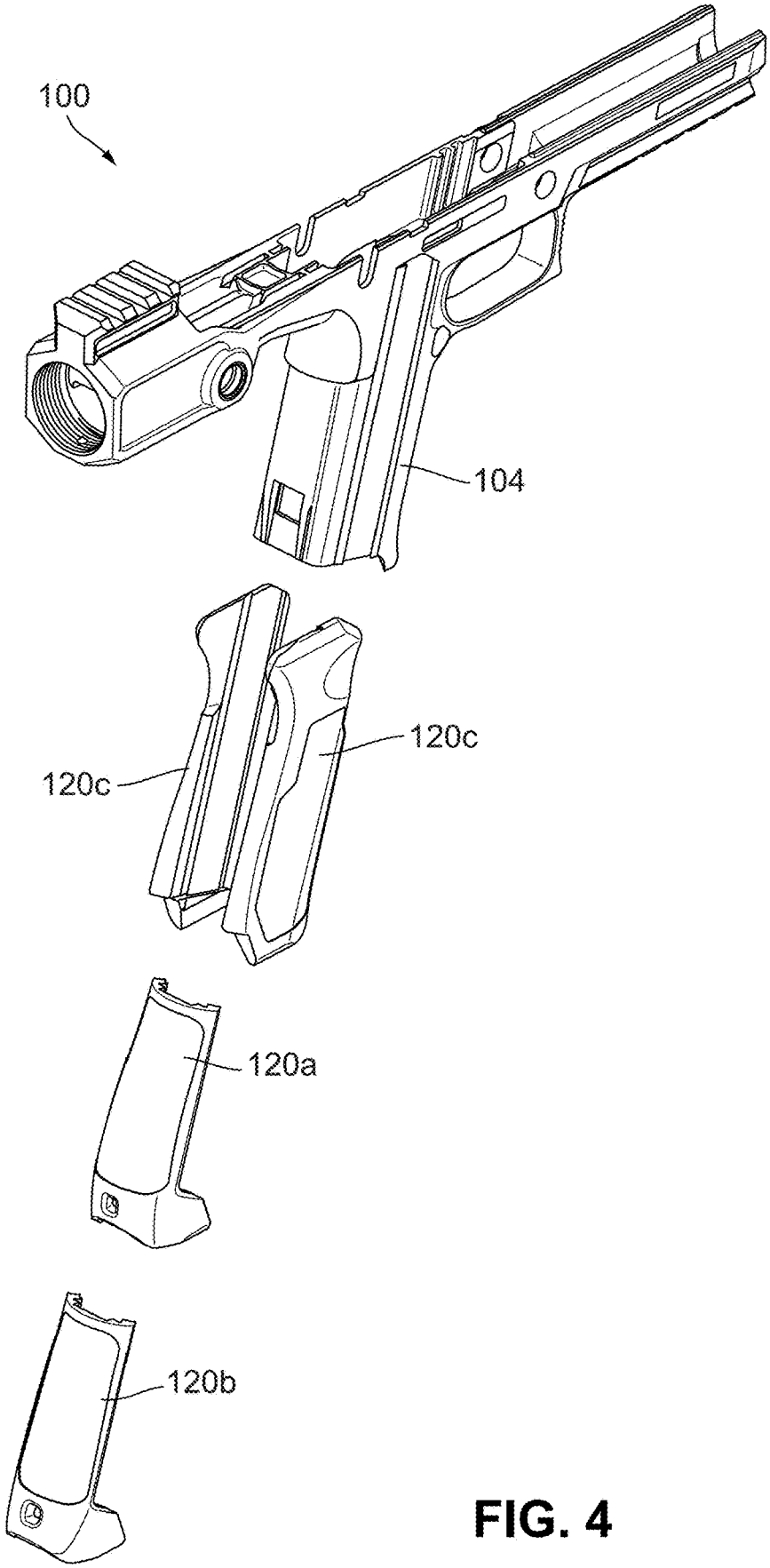
FIG. 4 is a rear-right perspective exploded-view of a grip module for a handgun including interchangeable pistol or hand grip panels as disclosed herein.

As shown in FIGS. 3A, 3B and 4, the grip module 100 may include a variety of rear grip panel 120*a* and 120*b* in various sizes, as well as left and right side grip panels 120*c* of various configurations and sizes. In some examples, grip panel 120*a* may be larger or more curved compared to a smaller grip panel 120*b* which may be more narrow and thinner compared to grip panel 120*a*. A shooter may choose a grip panel(s) 120*a*, 120, b, or 120*c* that best fits their hand. In other examples, pistol grip 104 of grip module 100 may be a standardized military specification (MIL-STD) size that is compatible with existing handgun grip panels/backstraps and products. In other examples, pistol grip 104 of grip module 100 may be configured and compatible with universal panels/backstraps used in other semi-automatic pistols. As also shown in FIG. 4, a horizontal cross-bar reinforcement 109 may be positioned in front of threading on the interior of buffer tube attachment point 108.

Figure 5:
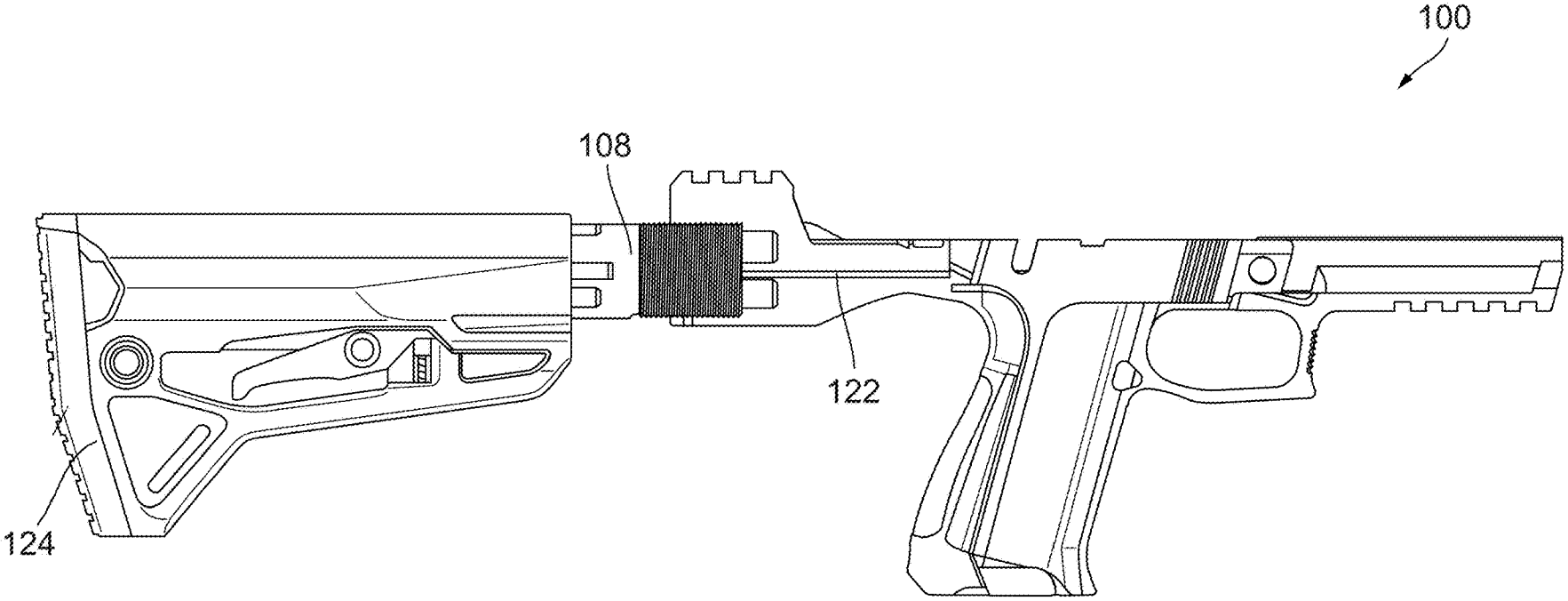
FIG. 5 is a side view of a grip module for a handgun including a metal reinforcement insert and a collapsible/extendable rifle stock as disclosed herein.

As shown in FIG. 5, grip module 100 for a handgun as disclosed herein may include metal reinforcement insert 122 to strengthen rear portion 103 of lower receiver 102 and/or buffer tube attachment point 108. Metal reinforcement insert 122 may be formed of a metal, and alloy, a polymer, a carbon composite, a composite, or combinations thereof. In some examples, metal reinforcement insert 122 may be integrally formed with grip module 100. In other examples, metal reinforcement insert 122 may be formed as a separate component and inserted into a cavity formed in the aft portion 103 of lower receiver 102 of grip module 100. Metal reinforcement insert 122 may provide additional strength to grip module 100, and in particular, buffer tube attachment point 108 for the attachment of removable stocks as shown in FIGS. 5 and 6A-6C.

For example, FIG. 5 depicts collapsible stock 124 engaged with an attached buffer tube or receiver extension 128. Collapsible stock 124 may be attached to buffer tube or receiver extension 128 by friction fit or mechanical fastener. In other examples, a pistol brace may be affixed to buffer tube or receiver extension 128.

Figure 6A:
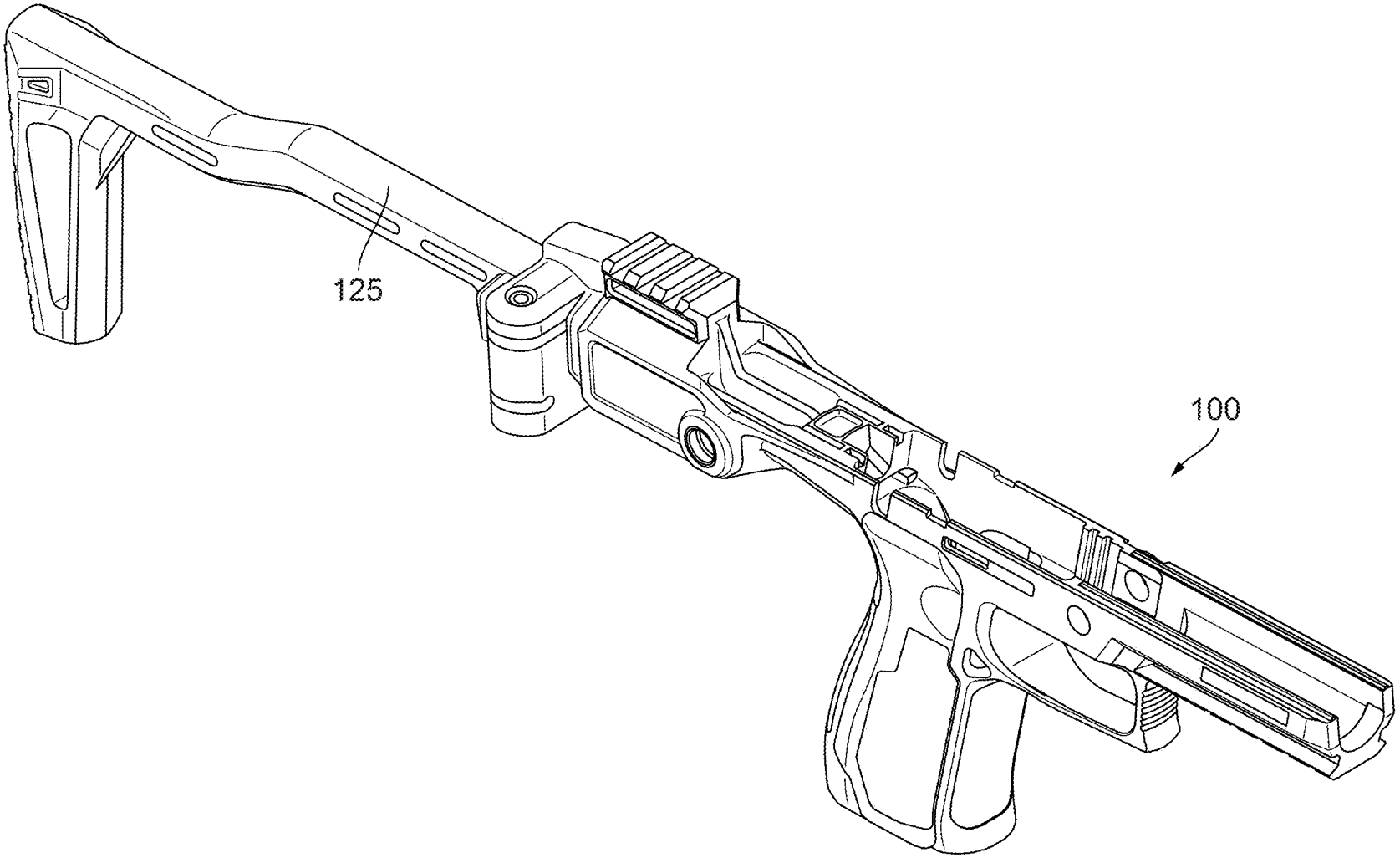
FIGS. 6A-6C are perspective and side views of a grip module for a handgun including a foldable rifle stock as disclosed herein.
Figure 6B:
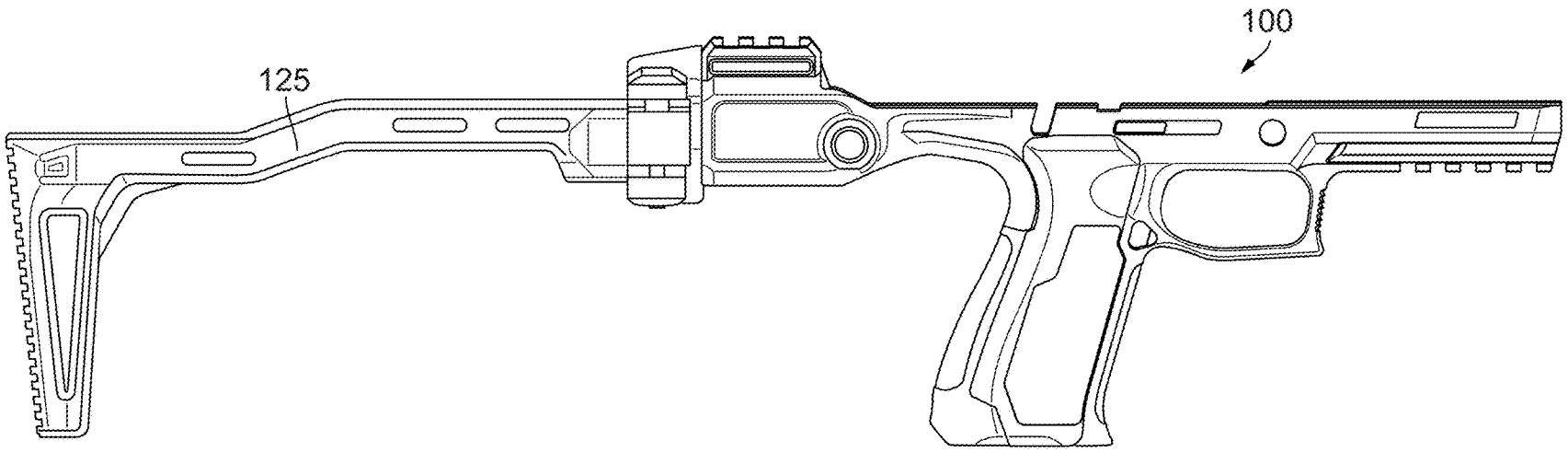
Figure 6C:
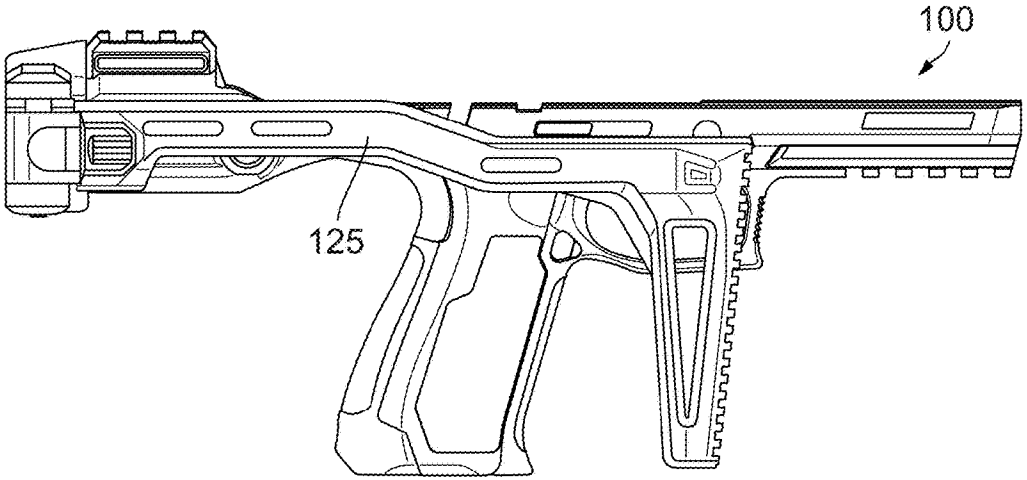

As shown in FIGS. 6A-C, foldable stock 125 may be removably affixed to buffer tube attachment point 108 with end cap 111 removed. Foldable stock 125 may be removably attached to buffer tube attachment point 108 by mechanical fastener via threading 110 on an interior portion of buffer tube attachment point 108. In other examples, foldable stock 125 may include a threaded end inserted into buffer tube attachment point 108. In another example, as shown in FIG. 6A, foldable stock 125 may include an attachment plate 130*a* configured to mate with attachment plate 130*b* removably affixed to buffer tube attachment point 108. Attachment plate 130*a* may be configured to removably engage attachment plate 130*b* via mechanical fastener(s).

The foregoing has been presented for purposes of example. The foregoing is not intended to be exhaustive or to limit features to the precise form disclosed. The examples discussed herein were chosen and described in order to explain principles and the nature of various examples and their practical application to enable one skilled in the art to use these and other implementations with various modifications as are suited to the particular use contemplated. The scope of this disclosure encompasses, but is not limited to, any and all combinations, sub combinations, and permutations of structure, operations, and/or other features described herein and in the accompanying drawing figures.

Although examples are described above, features and/or steps of those examples may be combined, divided, omitted, rearranged, revised, and/or augmented in any desired manner. Various alterations, modifications, and improvements will, in view of the foregoing disclosure, readily occur to those skilled in the art. Such alterations, modifications, and improvements are intended to be part of this description, though not expressly stated herein, and are intended to be within the spirit and scope of the disclosure. Accordingly, the foregoing description is by way of example only, and is not limiting.

What is claimed is:

1. A grip module system comprising:

a lower receiver, wherein the lower receiver is configured to engage a handgun trigger housing group and the handgun slide;

an integral pistol grip affixed to the lower receiver;

a buffer tube attachment point affixed to a rear portion of the lower receiver, wherein the buffer tube attachment point is configured to engage a rifle buffer tube; and an accessory rail removably attached to a top of the buffer tube attachment point.

2. The system of claim 1, wherein the lower receiver is compatible with multiple handgun firing components.

3. The system of claim 1, wherein the handgun is a Sig Sauer P320® or a Springfield Echelon™.

4. The system of claim 1, wherein the lower receiver, the pistol grip, and the buffer tube attachment point comprise a carbon fiber, a polymer, an alloy, a metal, or combinations thereof.

5. The system of claim 1, wherein the accessory rail is a 1913 picatinny rail.

6. The system of claim 1, wherein the buffer tube attachment point further comprises a sling attachment point.

7. The system of claim 1, wherein the rifle buffer tube is an AR-15 type buffer tube.

8. The system of claim 1, wherein the rifle buffer tube is configured to engage a rifle stock.

9. The system of claim 8, wherein the rifle stock is collapsible or foldable.

10. The system of claim 1, further comprising a barrel, a slide, a trigger, and a firing mechanism.

11. The system of claim 1, further comprising a lower accessory rail engaged with an illumination device.

12. The system of claim 1, further comprising an optic attached to the accessory rail.

13. The system of claim 1, further comprising a laser or IR pointer attached to the accessory rail.

14. A method of forming a grip module comprising the steps of:

forming a lower receiver, wherein the lower receiver is configured to engage a handgun trigger housing group and the handgun slide;

forming an integrated pistol grip affixed to the lower receiver;

forming a buffer tube attachment point affixed to a rear portion of the lower receiver, wherein the buffer tube attachment point is configured to engage a rifle buffer tube; and forming an accessory rail removably attached to a top of the buffer tube attachment point.

15. The method of claim 14, wherein the lower receiver is compatible with multiple handgun firing components.

16. The method of claim 14, wherein the lower receiver, the pistol grip, and the buffer tube attachment point comprise a carbon fiber, a polymer, an alloy, a metal, or combinations thereof.

17. The method of claim 14, further comprising the step of forming a sling attachment point affixed to the buffer tube attachment point.

18. The method of claim 14, wherein the rifle buffer tube is configured to engage a rifle stock.

19. The method of claim 18, wherein the rifle stock is collapsible or foldable.

20. The method of claim 14, wherein the handgun is a Sig Sauer P320® or a Springfield Echelon™.

* * * * *